United States Patent [19]

Saenz, Jr. et al.

[11] 4,440,391

[45] Apr. 3, 1984

[54] EXERCISE DEVICE

[76] Inventors: Arsenio B. Saenz, Jr., 1662 Mayfair St.; Gerald K. Cairns, 1676 Mayfair St., both of Simi, Calif. 93065

[21] Appl. No.: 413,968

[22] Filed: Sep. 1, 1982

[51] Int. Cl.[3] ..... A63B 23/00

[52] U.S. Cl. ..... 272/93; 403/296

[58] Field of Search ..... 272/93, 117, 125, 123, 272/126, 137; 135/114; 285/307, 370; 403/296, 295, 306

[56] References Cited

U.S. PATENT DOCUMENTS

| | | | |
|---|---|---|---|
| 405,128 | 6/1889 | Stockburger | 272/123 |
| 1,714,391 | 5/1929 | McWhirter | 272/93 |
| 1,907,960 | 5/1960 | Guillet | 403/296 |
| 2,714,008 | 7/1955 | Urban | 272/137 |
| 3,820,781 | 6/1974 | Kane | 272/126 |
| 3,942,790 | 3/1976 | Rice | 272/126 |
| 3,957,266 | 5/1976 | Rice | 272/125 |
| 3,961,814 | 6/1976 | Byrne | 285/370 |

FOREIGN PATENT DOCUMENTS

| | | | |
|---|---|---|---|
| 456791 | 3/1928 | Fed. Rep. of Germany | 272/123 |

*Primary Examiner*—Richard J. Johnson
*Attorney, Agent, or Firm*—Roger A. Marrs

[57] ABSTRACT

An exercising device is disclosed herein for promoting blood circulation and muscle toning which includes a plurality of elongated rod sections which are removably connected together in an end-to-end relationship to provide an elongated, composite shaft or bar of fixed length intended to be retained across the shoulders of the user by grasping the opposite ends of the composite shaft or bar or alternately for flexing the shaft or bar by the hands of the user. The adjacent ends of the rod sections are detachably joined together by a threaded coupling having a projecting threaded member insertably received within a threaded cavity of a receptacle member. External flanges and internal shoulders are cooperatively carried on the respective members for limiting coupling insertion and for properly seating the members together whereby a smooth and regular external surface is provided on the shaft or bar and which permits flexure of the shaft or bar without breakage or damage to the shaft on the coupling members during use.

1 Claim, 4 Drawing Figures

FIG. 1
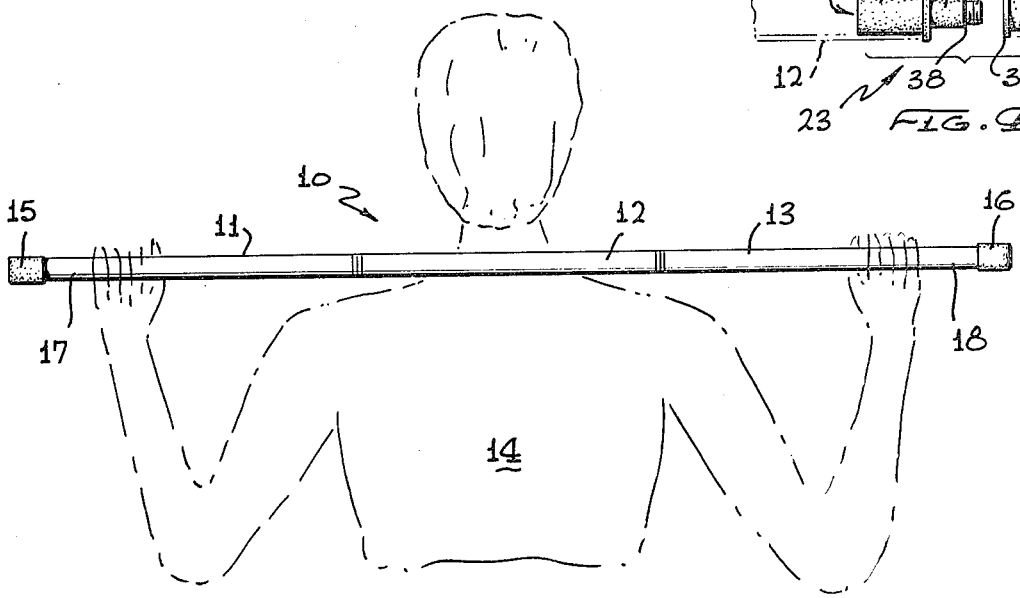
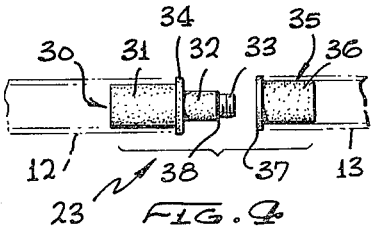
FIG. 4
FIG. 2
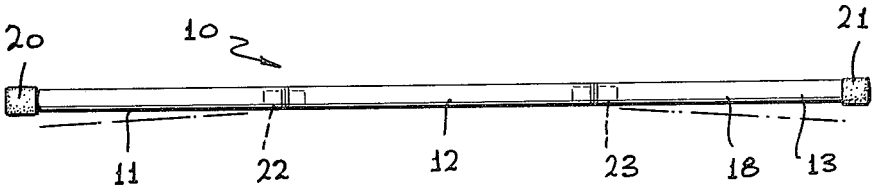
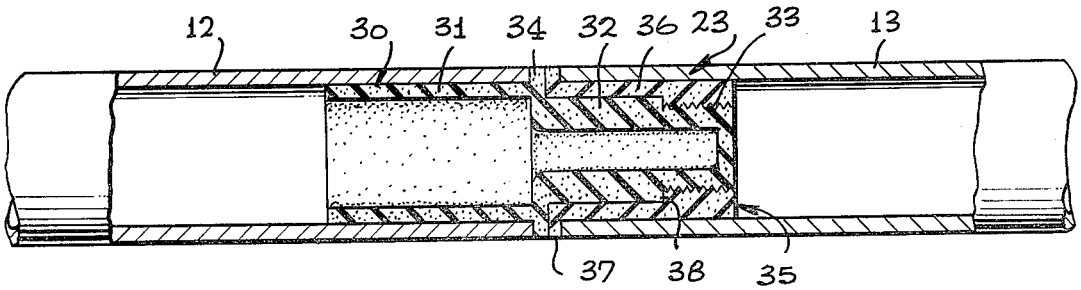
FIG. 3

EXERCISE DEVICE

BACKGROUND OF THE INVENTION

1. Field of the Invention

The present invention relates to exercising devices and more particularly to a novel exercise device adapted to be disassembled for storage and transportation purposes and which may be readily flexed or bent during selected exercises without damaging the device.

2. Brief Description of the Prior Art

In the past, it has been the conventional practice to use an elongated rod or bar of fixed length which is held behind the neck of the user on his shoulders and grasped at its opposite ends by the hands of the user so that the user may readily twist the upper torso at his waist to promote blood circulation and muscle toning. However, problems and difficulties have been encountered when using such a conventional bar which stem largely from the fact that the stick is continuous in its length and cannot be broken down into smaller components for storage or transportation purposes. Also, the conventional bars are of solid composition and do not readily bend or flex so that the bar cannot be used for stretching exercises or purposes or other exercises than the single exercise of upper torso rotation.

Other problems are encountered with conventional twist sticks or rods which stem largely from the fact that resistance in the form of weights cannot be ordinarily added to the opposite ends of the bar so as to add resistance to the torso twisting movement. Such resistance would greatly increase the value of the exercise for muscle building and toning.

Therefore, a long standing need has existed to provide a novel exercising device which may be readily used as a torso twisting stick but which has the added feature of being employed for stretching movements as well wherein the stick or bar may be readily bent or flexed by the user to increase resistance. Also, such an exercising bar should be capable of being disassembled for storage and transportation and when used as a flexing exercising bar, such flexures must not damage or mar any part of the exercising stick.

SUMMARY OF THE INVENTION

Accordingly, the above problems and difficulties are obviated by the present invention which provides a novel exercising device that may be readily used for exercising the upper torso by bracing the stick behind the neck on the shoulders of the user and rotating the torso back and forth. Also, the stick is useful in stretching exercises wherein one end of the stick may be supported against the floor while the opposite end of the stick is pulled by the hands of the user so as to bend or flex the stick while it is tensioned or resists the effort made by the user.

In one form of the invention, the exercising device constitutes an elongated rod or stick which is hollow and closed at its opposite ends with a cushion material or a weighted object. The length of the rod is divided into a plurality of rod sections which are detachably connected together in an end-to-end relationship. Coupling means are provided at the opposing adjacent ends of the respective rod sections for detachably securing the sections together and such means includes a plurality of spaced apart flanges and shoulders for supporting and transferring loads transferred therethrough during bending operations of the bar and which also serves as limiting stops for connection purposes between the rod sections.

Therefore, it is among the primary objects of the present invention to provide a novel exercising device which may readily be used for torso twisting exercises as well as for stretching exercises in which the stick offers substantial resistance to the efforts of the user.

Another object of the present invention is to provide a novel exercising bar or stick which is readily disassembled into a plurality of sections for storage and transportation purposes and when assembled, effectively transfers applied loads from section to section without damaging detachable connecting means between a plurality of sections combining to define the exercising bar.

Still a further object of the present invention is to provide a novel exercising device which has a multiplicity of uses and may be fabricated inexpensively and one that may be readily assembled and disassembled by the user without employing mechanical skill or special tools.

Yet another object of the present invention is to provide a novel exercising apparatus having dual purposes for promoting blood circulation and muscle toning that may be readily broken down into smaller segments or sections for storage and transportation purposes.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by references to the following description, taken in connection with the accompanying drawings in which:

FIG. 1 is a rear perspective view of an individual using the inventive exercising device of the present invention as a twist bar during upper torso twisting movement;

FIG. 2 is a side elevational view of the novel exercising device of the present invention showing the ability of the device to flex within a reasonable angle such as during stretching exercises;

FIG. 3 is an enlarged longitudinal cross-sectional view of a typical coupling means employed to join opposing opposite ends of bar sections used in the embodiment shown in FIGS. 1 and 2; and FIG. 4 is a reduced exploded view showing the coupling means as having a pair of threaded members preparatory to joining.

DESCRIPTION OF THE PREFERRED EMBODIMENT

Referring to FIG. 1, the novel exercising bar of the present invention is shown in the general direction of arrow 10 which includes a plurality of bar sections such as indicated by numerals 11, 12 and 13. The bar sections are detachably connected at their opposing adjacent ends so as to provide a continuous, elongated stick or bar that may be placed behind the neck of the user 14 and whereby the hands of the user may readily grasp the end marginal region of the stick 10. In this position, the user may twist his upper torso above the waist for blood circulating and muscle toning purposes. If desired, weights may be added to extreme ends of the stick as indicated by weights 15 and 16 so as to provide resistance to the twisting motion.

In other instances, when it is desired to use the stick for stretching exercises, the weights 15 and 16 may be replaced with a cushion or snubbing material so that the end of the stick may be placed against a support such as the floor or the ground. The hand gripping areas of the outer bars 11 and 13 are indicated by numerals 17 and 18 and may be provided with friction material that may be readily grasped by the hand of the user.

Referring now in detail to FIG. 2, it can be seen that the exercising bar or stick 10 includes snubbers or cushion material 20 and 21 on the opposite end of the stick 10 which replace the weights 15 and 16. In such a configuration, one end of the stick, such as end 20 may be placed on the floor while the opposite end may be grasped by both hands of the user such as around area 18 while one foot of the user is placed against the end 20. In this position, the user may flex the stick so that it will bend about its mid section so that resistance is offered to the movement and thereby the blood circulation and muscle toning of the user is achieved. An important feature of the present invention resides in the provision of coupling means indicated in general by numerals 22 and 23 which join the opposing ends of rod sections 11 and 12 and rod sections 12 and 13 respectively. By using the special coupling means, applied load forces during bending of the stick or bar 10 are transmitted between the respective bar sections and the total load is transferred to the supporting ground or floor. It is an important feature of the invention that the coupling means maintains a smooth and continuous exterior surface and strengthens the bar at the respective joints between the bar sections so that breakage or damage to the total elongated bar is avoided.

Referring now in detail to FIG. 3, the coupling means of the present invention is more clearly illustrated as represented in general by the arrow 23. The coupling means includes a projection member 30 having a cylindrical body 31 terminating at one end in a reduced portion 32 which is reduced at its extreme free end in a threaded portion 33. The cylindrical portion 31 is joined to the reduced portion 32 by means of an outwardly projecting flange 34 which bears on one side against the terminating end of the bar 12. It is to be particularly noted that bars are hollow and that the cylindrical portion 31 of the member 30 is insertably received into the hollow bore of the bar 12 and is retained therein by any suitable means such as a forced interference fit, adhesive, cement or the like. The coupling means 23 further includes a receptacle member 35 which includes a cylindrical portion 36 received into the hollow of the rod 13 and which includes an outwardly projecting flange 37 that is in abutting relationship with the flange 34 of the member 30 and the end of the rod 13. The receptacle member 35 includes a bore which receives the reduced portion 32 and is further provided with a threaded bore for threadably receiving the threaded portion 33 of the member 30. The projecting member 30 is in threaded connection with the receptacle member 35 until shoulders 38 bear against one another so that a limit stop is provided. Also, a limit stop is provided when the threaded portion 33 has been drawn into the receptacle portion sufficiently to engage the flange 34 with the flange 37. Therefore, the spacing of the shoulders 38 and of the flanges 34 and 37 are critical.

Referring now in detail to FIG. 4, an exploded view is shown in order to illustrate that the sections are readily detachably connected with one another and that the coupling means, such as means 23, is composed of two members, namely the projection member 30 and the receptacle member 35.

Preferably, the elongated tube and the component tube sections are composed of a plastic or plastic-like material so that the composite bar or shaft may be readily flexed. Therefore, it is understood that the shaft or rod is not rigid since the opposite ends of the bar or shaft may be moved about its mid section within the small angles approximately indicated in FIG. 2. In a similar manner, it is preferred that the coupling means be composed of a plastic or plastic-like material so that the respective members may be readily force fitted into engagement with the ends of the ends of the respective tubes or hollow bars. Furthermore, it is to be understood that the coupling means may be employed for other detachable connections for joining hollow tubes together and the use of such a coupling means is not limited to the joining of bar sections for providing the exercising device of the present invention.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An exercising device comprising the combination of:

a continuous, elongated bar having opposite free ends with end marginal regions;

said elongated bar being substantially hollow so as to be characterized as semi-rigid whereby said bar may be flexed or bent;

said elongated bar consisting of at least three bar sections detachably connected together at adjacent ends about the central longitudinal axis of said bar;

coupling means detachably connecting said sections together in load bearing relationship;

cushion members removably carried on the extreme free ends of said elongated bar;

said coupling means includes a cylindrical member having a projecting threaded portion carried on one of said bar sections and a cylindrical receptacle member having a threaded bore carried on another of said bar sections;

said receptacle member adapted to detachably couple with said projecting member threaded portion so that said bar sections lie on a common central longitudinal axis;

each of said coupling means members include end flanges separating the extreme opposing ends of respective bar sections coupled together; and said coupling means members include stop means for limiting insertion of said projecting threaded portion into said threaded receptacle portion.

* * * * *